US009314899B2

(12) United States Patent
Puchegger et al.

(10) Patent No.: US 9,314,899 B2
(45) Date of Patent: Apr. 19, 2016

(54) GRINDING TOOL FOR THE SIMULTANEOUS SANDING AND POLISHING OF FLOORS

(75) Inventors: Alfred Puchegger, Krumbach (AT); Hermann Beisteiner, Krumbach (AT)

(73) Assignee: PUCHEGGER JILG PARKETT GROSS U. EINZELHANDELS GES.M.B.H., Krumbach (AT)

( * ) Notice: Subject to any disclaimer, the term of this patent is extended or adjusted under 35 U.S.C. 154(b) by 222 days.

(21) Appl. No.: 13/805,973

(22) PCT Filed: Jun. 23, 2010

(86) PCT No.: PCT/AT2010/000230

§ 371 (c)(1),
(2), (4) Date: Mar. 15, 2013

(87) PCT Pub. No.: WO2011/160142

PCT Pub. Date: Dec. 29, 2011

(65) Prior Publication Data

US 2013/0178137 A1 Jul. 11, 2013

(51) Int. Cl.

| | |
|---|---|
| ***B24B 23/00*** | (2006.01) |
| ***B24B 7/18*** | (2006.01) |
| ***B24B 41/047*** | (2006.01) |

(52) U.S. Cl.
CPC ..... *B24B 41/047* (2013.01); *B24B 7/18* (2013.01); *B24B 7/186* (2013.01)

(58) Field of Classification Search
CPC ..... B24B 7/18; B24B 7/186; B24B 7/20; B24B 7/22
USPC ..... 451/350, 353, 359, 538, 539
See application file for complete search history.

(56) References Cited

U.S. PATENT DOCUMENTS

| | | | | |
|---|---|---|---|---|
| 1,284,092 | A * | 11/1918 | Gray | 144/38 |
| 4,675,975 | A * | 6/1987 | Kucharczyk et al. | 451/461 |
| 5,081,734 | A * | 1/1992 | Sandford et al. | 451/353 |
| 5,514,027 | A * | 5/1996 | Pearlman | 451/353 |
| 5,725,423 | A * | 3/1998 | Barry et al. | 451/539 |
| 5,885,139 | A * | 3/1999 | Lemieux et al. | 451/69 |
| 6,234,886 | B1 * | 5/2001 | Rivard et al. | 451/353 |
| 7,022,004 | B2 * | 4/2006 | Bohler | 451/366 |
| 7,204,745 | B2 * | 4/2007 | Thysell | 451/526 |
| 8,272,924 | B2 * | 9/2012 | Van Eijden et al. | 451/56 |
| 8,303,374 | B2 * | 11/2012 | Thysell et al. | 451/41 |
| 8,585,466 | B2 * | 11/2013 | Van Eijden et al. | 451/56 |
| 2005/0054279 | A1 * | 3/2005 | Jordan | 451/350 |
| 2008/0176497 | A1 | 7/2008 | Estes | |

FOREIGN PATENT DOCUMENTS

| | | |
|---|---|---|
| DE | 20 2006 014 965 | 2/2008 |
| JP | 61 192801 | 12/1986 |
| JP | 3 015070 | 2/1991 |
| KR | 100 816 026 | 3/2008 |
| WO | WO 87/03241 | 6/1987 |
| WO | WO 2008/153486 | 12/2008 |

* cited by examiner

*Primary Examiner* — Robert Rose
(74) *Attorney, Agent, or Firm* — Cozen O'Connor

(57) ABSTRACT

A grinding tool carrier (1) having substantially circular grinding discs (2), on which an abrasive covering is detachably secured, wherein chip-removing cutters (4) are arranged on the grinding tool carrier (1) and between the grinding discs (2).

9 Claims, 1 Drawing Sheet

GRINDING TOOL FOR THE SIMULTANEOUS SANDING AND POLISHING OF FLOORS

RELATED APPLICATIONS

This is a U.S. national stage of application No. PCT/AT2010/000230, filed on Jun. 23, 2010.

FIELD OF THE INVENTION

The invention relates to a grinding tool carrier having substantially circular grinding discs, on which an abrasive covering is detachably secured.

BACKGROUND OF THE INVENTION

It is known to machine wooden floors using belt-type sanding machines or machines with rotating sanding wheels, in order to clean the surfaces or smooth them, or to abrade them by a defined amount. It is also known to plane wooden floors or larger wooden surfaces in general by machine in order to level or straighten them or to abrade them. One disadvantage of sanding machines is that in repairing sunken-in or heavily worn wooden floors, the abrasive medium becomes sticky from dirt, paint and oil residues in the wood. Also, major areas of unevenness occur in worn-down floors, which can be sanded down only with tedious effort. Machines are also known which can be equipped with abrasive media or cutting heads in alternation. A disadvantage of those provisions is that the cutting heads are limited to machining only plaster floors, although the machines equipped with abrasive media are intended for machining wooden floors.

It is an object of the invention to create a grinding tool carrier for a floor sander that makes it possible to plane and sand floors, and in particular wooden floors, simultaneously and also to adapt the penetration depth of the planing blades. A further object is to enable easy adaptation of the penetration depth and to make it adjustable even to the extent of completely eliminating the penetration depth.

The grinding tool carrier of an embodiment of the invention achieves this in that chip-removing cutters are arranged on the grinding tool carrier and between the grinding discs.

A preferred embodiment of the grinding tool carrier is distinguished in that the cutters are hard-metal indexing plates.

A further preferred embodiment of the grinding tool carrier is distinguished in that the grinding discs are coated with a medium by means of which the abrasive covering can be detachably secured, and this medium is one of two surfaces of a hook-and-loop closure.

The grinding tool carrier according to an embodiment of the invention furthermore attains the objects of the invention in that it has abrasive coverings, which comprise substantially circular-disc-shaped sandpapers that are coated, on their side facing away from the abrasive medium, with a medium for detachably securing them to grinding discs, and that by means of the paper thickness of the sandpapers, the height of the abrasive coverings in proportion to the height of the cutters can be adjusted.

A preferred embodiment of the grinding tool carrier is distinguished in that the paper thicknesses depend on the particle size of the abrasive medium.

A further preferred embodiment of the grinding tool carrier is distinguished in that at least one piece of sandpaper is firmly joined, on the side facing away from the abrasive medium, to a felt, and the felt is in turn firmly joined to one surface of a hook-and-loop closure.

BRIEF DESCRIPTION OF THE DRAWINGS

The invention is described below in further detail in terms of an exemplary embodiment shown in the drawings. In the drawings.

DETAILED DESCRIPTION OF THE DRAWINGS

Figure 1:
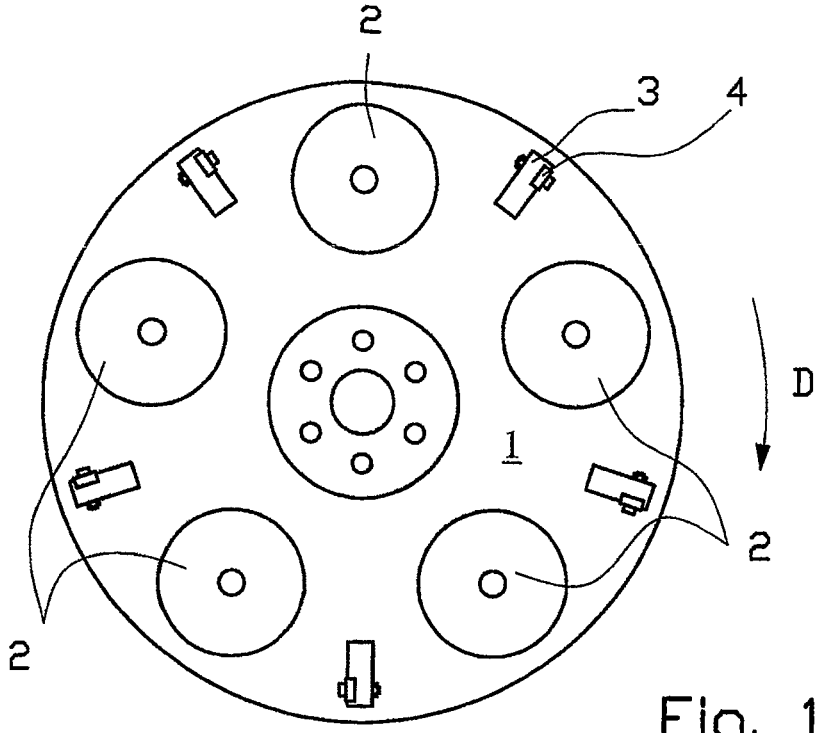
FIG. 1 is a plan view on the underside of a grinding tool carrier.
Figure 2:
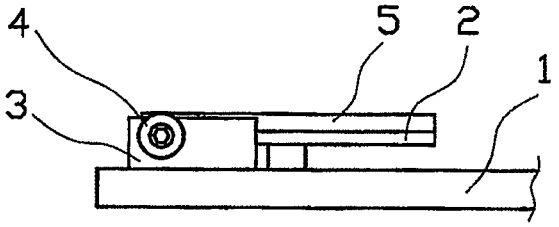
FIG. 2 shows a detail of a side view on the grinding tool carrier.

In FIG. 1, a plurality of grinding discs 2 are joined in such a way to a grinding wheel or grinding tool carrier 1, which may be embodied as a solid aluminum plate, that they can rotate freely. The grinding tool carrier 1 is made to rotate in the direction D by a drive means. As shown in FIG. 2, an abrasive covering 5 is mounted on the sides of the grinding discs 2 that face the floor. The abrasive covering 5 may for instance be sandpaper. In FIG. 2, the side that faces the surface that is to be machined points upward. The abrasive covering 5 and the grinding disc 2 can be detachably joined to one another by means of hook-and-loop closures. As also shown in FIG. 1, cutting heads 3 equipped with cutters 4 are arranged between the grinding discs 2 and are firmly joined to the grinding tool carrier 1. It can be seen from FIG. 2 that the lower edge of the cutters 4 extends at a height that is similar or identical to the sanding plane of the abrasive covering 5. This ensures that the surface to be machined is simultaneously planed and sanded. Particularly in surfaces that are dirty or oily, this arrangement achieves the effect that the cutters 4 lift off the intended substances and prevent sticky penetration into the abrasive covering 5.

FIG. 2 also shows the form of embodiment of the sanding means. The cutting head 3 is embodied as a block, into which disk-shaped cutters 5 (for example, hard-metal indexing plates) are inserted and screwed firmly.

Depending on the nature of the floor and on the work procedure, it may be advantageous that the cutters 4 are not located in the same plane as the abrasive coverings 5. A height difference, which is in the range of a few tenths of a millimeter, for instance, can be established by providing that abrasive coverings 5 of varying thickness are mounted on the grinding discs 2. The thickness can depend on the particle size of the sandpaper. FIG. 4 shows a further thickness-varying arrangement for the abrasive covering 5. Here again, the side that faces toward the surface to be machined points upward. The abrasive medium 6 is firmly joined to a felt 8, for example by means of an adhesive layer 9. By means of the thickness of the felt 8, the thickness of the abrasive covering 5 and thus the height of the sanding plane can be controlled.

Figure 3:
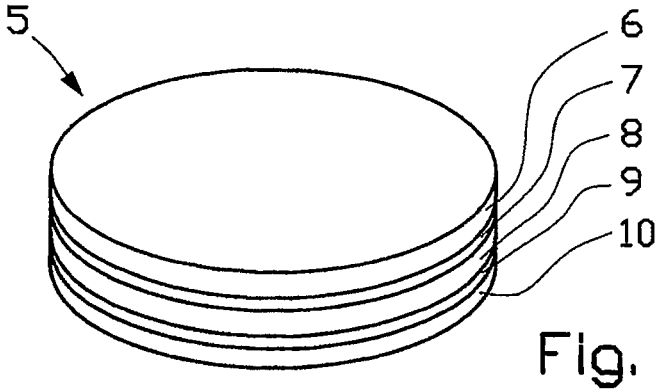
FIG. 3 shows an abrasive covering.

Changing from a simple abrasive covering 5 to an abrasive covering 5 as shown in FIG. 3 makes the desired change in the height difference between the abrasive covering 5 and the sanding height of the cutters 4. By this provision, the cutters 4 can also be lifted entirely away from the surface to be machined, so that the overall floor sander then functions only purely as a sander. This can be desirable, especially for fine polishing.

A further advantage of this is that by means of the felt 8, a soft, adaptable support for the sandpaper is created.

It is understood that the exemplary embodiments described can be modified in various ways within the scope of the concept of the invention, for instance with regard to the type of sandpaper; the type of abrasive particle; the adhesive; the means for joining the abrasive covering, felt or grinding disc; the number of grinding discs; or the type of cutter.

The invention claimed is:

1. A grinding tool carrier comprising:

substantially circular grinding discs arranged on a side of the grinding tool carrier that faces the floor, on each of which an abrasive covering is detachably secured; and chip-removing cutters arranged on the side of the grinding tool carrier that faces the floor on the grinding tool carrier between the grinding discs arranged on the side of the grinding tool carrier that faces the floor.

2. The grinding tool carrier according to claim 1, wherein the chip-removing cutters are hard-metal indexing plates.

3. The grinding tool carrier according to claim 1, wherein the grinding tool carrier comprises five of the grinding discs and five of the chip-removing cutters.

4. The grinding tool carrier according to claim 1, wherein the grinding discs are coated with a medium by which the abrasive covering is detachably secured, the medium being one of two surfaces of a hook-and-loop closure.

5. The grinding tool carrier according to claim 1, wherein the abrasive coverings each have an abrasive medium on one side thereof, and each comprise substantially circular-disc-shaped sandpapers that are coated, on a side facing away from the abrasive medium, with a medium for detachably securing the sandpapers to respective ones of the grinding discs, wherein the height of the abrasive coverings is adjustable in proportion to the height of the cutters by selection of sandpapers having various paper thicknesses.

6. The grinding tool carrier according to claim 5, wherein the paper thicknesses depend on the particle size of the abrasive medium.

7. The grinding tool carrier according to claim 5, wherein at least one piece of the sandpaper is firmly joined, on the side facing away from the abrasive medium, to a felt, and the felt is in turn firmly joined to one surface of a hook-and-loop closure.

8. A floor sander having a grinding tool carrier according to claim 1.

9. The grinding tool according to claim 1, wherein the grinding tool is in the form of a grinding disk, and wherein respective ones of the substantially circular grinding discs and respective ones of the chip-removing cutters are alternatingly disposed about a periphery of the grinding disk.

* * * * *